US005352338A

United States Patent [19]

Juric et al.

[11] Patent Number: 5,352,338

[45] Date of Patent: Oct. 4, 1994

[54] CATHODE PROTECTION

[75] Inventors: Drago D. Juric, Bulleen Victoria; Kevin D. Watson, Salisbury East South Australia; Raymond W. Shaw, North Balwyn Victoria, all of Australia

[73] Assignee: Comalco Aluminium Limited, Melbourne, Australia

[21] Appl. No.: 28,188

[22] Filed: Mar. 9, 1993

Related U.S. Application Data

[63] Continuation of Ser. No. 896,902, Jun. 11, 1992, abandoned, which is a continuation of Ser. No. 481,844, Feb. 20, 1990, abandoned.

[30] Foreign Application Priority Data

Feb. 20, 1989 [AU] Australia ..... PJ2827

[51] Int. Cl.[5] ..... C25B 3/06

[52] U.S. Cl. ..... 204/67; 204/147

[58] Field of Search ..... 204/67, 243 R, 209 R, 204/291, 292, 147; 205/230, 233, 170, 159, 333

[56] References Cited

U.S. PATENT DOCUMENTS 4,560,448 12/1985 Sane et al. ..... 204/67

5,028,301 7/1991 Townsend ..... 204/67

FOREIGN PATENT DOCUMENTS 0137412 10/1979 Japan ..... 204/67

*Primary Examiner*—Kathryn Gorgos

*Attorney, Agent, or Firm*—Nikaido, Marmelstein, Murray & Oram

[57] ABSTRACT

A method of operating an aluminum smelting cell during the start-up phase of the cell is described. The method includes forming a layer of boron oxide on the exposed surface of the cathode of the cell, forming a layer of aluminum on the boron oxide layer, and starting the cell. This melts the boron oxide layer to form a barrier impervious to oxygen at a temperature from about 400° C. to about 650° C., and the aluminum layer is melted to form a barrier to oxygen at temperature above about 600° C. to about 1000° C. to reduce the development of oxidation products.

27 Claims, No Drawings

CATHODE PROTECTION

This is a continuation of application Ser. No. 07/896,902 filed Jun. 11, 1992, now abandoned which is a continuation of Ser. No. 07/481,844 filed Feb. 2, 1990, now abandoned.

FIELD OF THE INVENTION

This invention relates to the protection of refractory hard material cathodes used in aluminum smelting cells and to aluminium smelting systems incorporating such protected cathodes.

BACKGROUND OF THE INVENTION

In conventional designs for the Hall-Heroult cell, the molten aluminium pool or pad formed during electrolysis itself acts as part of the cathode system. The life span of the carbon lining or cathode material may average three to eight years, but may be shorter under adverse conditions. The deterioration of the carbon lining material is due to erosion and penetration of electrolyte and liquid aluminium as well as intercalation by metallic sodium, which causes swelling and deformation of the carbon blocks and ramming mix. Penetration of cryolite through the carbon body has caused heaving of the cathode blocks. Aluminium penetration to the iron cathode bars results in excessive iron content in the aluminium metal, or in more serious cases, a tap-out.

Another serious drawback of the carbon cathode is its non-wetting by aluminum, necessitating the maintenance of a substantial height of pool or pad of metal in order to ensure an effective molten aluminum contact over the cathode surface. In conventional cell designs, a deep metal pad promotes the accumulation of undissolved material (sludge or muck) which forms insulating regions on the carbon cathode surface. Another problem of maintaining such an aluminium pool is that electromagnetic forces create movements and standing waves in the molten aluminium. To avoid shorting between the metal and the anode, the anode-to-cathode distance (ACD) must be kept at a safe 4 to 6 cm in most designs. For any given cell installation, where is a minimum ACD below which there is a serious loss of current efficiency, due to shorting of the metal (aluminium) pad to the anode, resulting from instability of the metal pad, combined with increased back reaction under highly stirred conditions. The electrical resistance of the inter-electrode distance traversed by the current through the electrolyte causes a voltage drop in the range of 1.4. to 2.7 volts, which represents from 30 to 60 percent of the voltage drop in a cell, and is the largest single voltage drop in a given cell.

To reduce the ACD and associated voltage drop, extensive research using Refractory Hard Materials (RHM). such as titanium diboride ($TiB_2$), as cathode materials has been carried out since the 1950's. Because titanium diboride and similar Refractory Hard Materials which are wetted by aluminium, resist the corrosive environment of a reduction cell, and are excellent electrical conductors, numerous cell designs utilizing Refractory Hard Materials have been proposed in an attempt to save energy, in part by reducing anode-to-cathode distance.

The use of titanium diboride current-conducting elements in electrolytic cells for the production or refining of aluminum is described in the following exemplary U.S. patents: U.S. Pat. Nos. 2,915,442, 3,028,324, 3,215,615, 3,314,876, 3,330,756, 3,156,639, 3,274,093, and 3,400,061. Despite the rather extensive effort expended in the past, as indicated by those and other patents, and the potential advantages of the use of titanium diboride as a current-conducting element, such compositions have not been commercially adopted on any significant scale by the aluminium industry.

Lack of acceptance of $TiB_2$ or RHM current-conducting elements of the prior art is related to their lack of stability in service in electrolytic reduction cells. It has been reported that such current-conducting elements fail after relatively short periods in service. Such failure has been associated with the penetration of the self-bonded RHM structure by the electrolyte, and/or aluminium, thereby causing critical weakening with consequent cracking and failure. It is well known that liquid phases penetrating the grain boundaries of solids can have undesirable effects. For example, RHM tiles wherein oxygen impurities tend to segregate along grain boundaries are susceptible to rapid attack by aluminium metal and/or cryolite bath. Prior art techniques to combat $TiB_2$ tile disintegration in aluminium cells have been to use highly refined $TiB_2$ powder to make the tile, where commercially pure $TiB_2$ powder contains about 3000 ppm oxygen.

Moreover, fabrication further increases the cost of such tiles substantially. However, no cell utilizing $TiB_2$ tiles is known to have operated successfully for extended periods without loss of adhesion of the tiles to the cathode, or disintegration of the tiles. Other reasons proposed for failure of RHM tiles and coatings have been the solubility of the composition in molten aluminium or molten flux, or the lack of mechanical strength and resistance to thermal shock. Additionally, different types of $TiB_2$ coating materials, applied to carbon substrates, have failed due to differential thermal expansion between the titanium diboride materials and the carbon cathode block or chemical attack of the binder materials. To our knowledge no prior RHM containing materials have been successfully operated as a commercially employed cathode substrate because of thermal expansion mismatch, bonding problems, chemical crosion, etc.

Titanium diboride tiles of high purity and density have been tested, but they generally exhibit poor thermal shock resistance and are difficult to bond to carbon substrates employed in conventional cells. Mechanisms of debonding are believed to involve high stresses generated by the thermal expansion mismatch between the titanium diboride and carbon, as well as aluminium penetrating along the interface between the tiles and the adhesive holding the tiles in place, due to wetting of the bottom surface of the tile by aluminium. In addition to debonding, disintegration of even high purity tiles may occur due to aluminium penetration of grain boundaries. These problems, coupled with the high cost of the titanium diboride tiles, have discouraged extensive commercial use of titanium diboride elements in conventional electrolytic aluminium smelting cells, and limited their use in new cell design. To overcome the deficiencies of past attempts to utilize Refractory Hard Materials as a surface element for carbon cathode blocks, coating materials comprising Refractory Hard Materials is a carbonaceous matrix have been suggested.

In U.S. Pat. Nos. 4,526,911, 4,466,996 and 4,544,469 by Boxall ct al, formulations, application methods, and cells employing $TiB_2$/carbon cathode coating materials were disclosed. This technology relates to spreading a mixture of Refractory Hard Material and carbon solids with thermosetting carbonaceous resin on the surface of a cathode block, followed by cure and bake cycles. Improved cell operations and energy savings result from the use of this cathode coating process in conventionally designed commercial aluminium reduction cells. Plant test data indicate that the energy savings attained and the coating life are sufficient to make this technology a commercially advantageous process.

Advantages of such composite coating formulations over hot pressed RHM tiles include much lower cost, less sensitivity to thermal shock, thermal expansion compatibility with the cathode block substrate, and less brittleness. In addition, oxide impurities are not a problem and a good bond to the carbon cathode block may be formed which is unaffected by temperature fluctuations and cell shutdown and restart. Pilot plant and operating cell short term data indicate that a coating life of from four to six years or more may be anticipated, depending upon coating thickness.

The baking process should be carried out in an inert atmosphere, coke bed or similar protective environment to prevent "excessive air burn". In laboratory studies, it is possible to bake the test samples in a retort which maintains a high grade inert atmosphere and excludes air/oxygen ingress; however, this is not practical for commercial use. Baking under a coke bed is reported to give satisfactory protection for the $TiB_2$/carbon composite material.

Composite coatings have been tested in plants using full scale aluminium reduction cells (U.S. Pat. No. 4,624,766; Light Metals 1984. pp 573–588; A. V. Cooke et al., "Methods of Producing $TiB_2$/Carbon Composites for Aluminium Cell Cathodes", Proceedings 17th Biennial Conference on Carbon, Lexington, Kentucky (1985)). After curing, the coating is quite hard and the coated blocks may be stored indefinitely until baking. For baking, the coated blocks were placed in steel containers, covered with a protective coke bed, and baked using existing plant equipment such as homogenizing furnaces. Once baked, the blocks could be handled without further procautions during cell reline procedures. The integrity of the cured coating and substrate bond remained excellent after baking. No changes in cell start-up procedure were required for using the blocks coated with composite $TiB_2$ material. No difficulties were encountered when the coated cathode cells were started-up using either a conventional coke resistor bake or hot metal start-up procedure. Core samples from the test cells demonstrated areas of good coating condition after 109 and 310 days of service in the operating cell, but performance was non-uniform.

Extensive testing of $TiB_2$/carbon composite materials have been performed in both laboratory and plant tests. The improved laboratory tests and more detailed cell autopsies have shown a variability in material performance not observed in previously reported tests. The x-Ray Diffraction (XRD) analysis was used to measure the trace impurities in the test samples. It was discovered that the poor performance of a test material had a direct correlation with the presence of oxidation products of Ti and B such as TiO and/or $TiBO_3$, within the structure of the material. A similar variation was detected in the RHM coating applied to a carbon cathode.

Laboratory tests demonstrated that none of the conventional methods (e.g. coke bed, inert gas, liquid metal, boron oxide coating on anodes) for preventing/controlling carbon oxidation was adequate to prevent the formation of $TiBO_3$ or similar oxidation products during the bake operation and/or the cell start-up.

In addition to the above described problems associated with RHM cathodes, the start-up phase of operation of conventional cells can also result in oxidation damage leading to reduced operational life, and the present invention is not therefore limited to cells have RHM cathodes.

BRIEF DESCRIPTION OF INVENTION AND OBJECTS

It is a primary object of a present invention to provide a method of protecting aluminium smelter cathodes against deterioration in use, and more specifically to provide an improved start-up procedure by means of which the life of aluminium smelter cell cathodes may be extended.

In its broadest form, the invention provides an improved start-up procedure for aluminium smelting cells characterized by the creation or establishment of conditions which reduce the formation of oxides from external oxidant sources in cathode materials during the start-up period of the cell. This reduction in the formation of oxides will result in cathode materials having superior longevity when compared with Refractory Hard Materials and other cathode materials which have not been similarly protected against the development of oxide products.

In one currently preferred form of the invention, the desired conditions are established in the smelting cell by the formation of a barrier which is liquid or molten during the start-up temperatures above about 400° C., which is in intimate contact with the exposed surfaces of the cathode, which is stable and effective at temperatures up to about 1000° C. and which is substantially impervious to oxygen throughout the start-up period of the cell.

One of the major advantages of the use of a barrier which is liquid or molten is that it allows outgassing from the refractory material during the start up procedure while preventing the return of such gases or other oxidants to the cathode material. This would not be the case where say a gaseous barrier is present since the outgasses and other oxidants may readily mix with the barrier gas and will, therefore, be free to react with the cathode material.

The barrier may be formed of two materials, one which is effective up to one temperature and the other effective from said one temperature to temperatures up to about 1000° C.

In one form of the invention, this is achieved by the use of boron oxide ($B_2O_3$), which melts at about 450°–470° C. or lower due to impurities, or some other suitable material which is liquid or molten at temperatures above about 400° C., which is substantially impervious to oxygen transport and which wets carbon. This material provides a barrier which substantially prevents the Refractory Hard Materials (or other cathode materials) of the cathode from being oxide contaminated. At temperatures above about 650°–700° C. at which the boron oxide material is likely to be less effective, aluminium pellets or the like which are added to the cell with the boron oxide and form a molten aluminium barrier which functions during start up until the cell starts producing aluminium which functions as a barrier for the remainder of the operating life of the cell. Thus, by establishing a substantially oxygen impermeable barrier which essentially prevents formation of oxides during the start-up period, the cathode of the cell is protected against subsequent damage of the type outlined above.

The boron oxide can be used directly or alternatively can be formed in situ by controlled oxidation of a $TiB_2$ containing material such as the refractory hard material coating or a commercially available product such as Graphi-Coat.

In another aspect, the invention provides a method of reducing the development of oxidation products in Refractory Hard Material or other cathodes during the cell start-up procedure, comprising the step of adding to the cell at least one material which is liquid or molten at temperatures above about 400° C. and which is stable at temperatures up to about 1000° C., which covers the cathode of the cell and thereby forms a barrier to oxygen, and which does not materially affect the operation of the cell.

In one preferred form, the method includes adding a first material which is liquid or molten at temperatures above about 400° C. and which is substantially impervious to oxygen transport, as well as a second material which is liquid or molten at temperatures above about 600° C. and which forms a substantially impervious barrier to oxygen transport.

While a currently preferred first material is boron oxide ($B_2O_3$), other materials which are liquid or molten at about 400° C. and which form a carbon wetting film substantially impervious to oxygen at temperatures above 400° C. may be used. For example, materials such as mixtures of chloride or fluoride salts or liquid melts such as lead tin alloys may be used, although they are currently considered to be less practical than boron oxide. The boron oxide can be used directly or alternatively can be formed in situ by controlled oxidation of a $TiB_2$ containing material such as the refractory hard material coating or a commercially available product such as Graphi-Cost (trade mark). While use of this alternative method may result in an outer skin of oxide contaminated RHM, this skin may be regarded as a sacrificial layer which an operator is willing to lose in return for a protection system which is less complex and costly to operate. The effectiveness of this alternative protection method will be dependent on the porosity of the refractory hard material with lower porosities giving better results.

Clearly, the most preferable second material, for practical reasons, is aluminium metal since this is present in the cell in any event. However, other metals or compounds, which are fluid at about 600° C. and above, which completely cover the carbon to create a substantially impervious barrier to oxygen transport may be used.

In the post-start-up phase of operation of the cell, it may be necessary or desirable to remove the viscous boron oxide layer, or other viscous layer derived from the boron oxide coating, which adhere to the surface of the cathode. While this removal may be achieved in a number of ways, such as flushing the cell with fresh metal to physically remove the layer, it is presently preferred to remove the layer chemically by converting the boron oxide into a more innocuous boron-containing phase such as by contacting the boron oxide phase with Ti-containing species, leading to the precipitation of $TIB_2$. For example, Ti-bearing additions such as $TiO_2$ may be added to the electrolyte or Ti-Al alloys may be added to the metal. Other transition metal species in the fourth to sixth groups of the periodic system which are able to form borides from the boron oxide layer may also be used with acceptable results, such as Zr, Hf, V, Nb, Ta, Cr, Mo and W.

DESCRIPTION OF PREFERRED EMBODIMENTS

In the following description, the conditions under which RHM material can be heated above 400° C. without degrading its consistency and service life in an aluminium cell will be outlined in greater detail. Two types of $TiB_2$/carbon composite materials were evaluated in laboratory and plant exposure tests to determine their uniformity and service life when used to form an aluminium wetted cathode surface for the electrolytic winning of aluminium from a molten cryolite based bath. The cathode coating material was formulated, mixed, applied to the cathode block top surface and cured as taught in U.S. Pat. No. 4,526,911 to Boxall et al. The cured coating blocks were then baked under a fluid coke bed as described by Boxall et al. A nitrogen purge was maintained through the metal box containing the coated blocks and fluid coke to prevent any ingress of air during the bake procedure. After cooling to less than 200° C., the baked coated blocks were removed from the coke bed. Normal cell construction procedures were used to construct a conventional pre-bake cathode using the coated blocks.

The cathode tiles were molded, cured and baked as taught in U.S. Pat. No. 4,582,553 by Buchta. A fluid coke bed with a nitrogen purge was used to protect the tiles from "excessive air burn". The tiles were attached to the top of the cathode blocks in a conventionally rammed cathode using UCAR C-34 cement as described by Buchta.

A conventional resistor coke bed start-up procedure was used to heat the coated lined cathode cell up to about 900°–950° C. before fluxing with molten bath transferred from other cells in the potline. The test cells were operated as regular cells for approximately 6 weeks before the shut down for autopsy. Most of the bath and metal were tapped from the cell during the shutdown procedure. After cooling, the remaining bath and metal were removed from the cathode surface to expose the coated tiled surface. Visual inspection and photographs of the cathode surface were used to evaluate the condition of the exposed cathode coating tiles. Core samples were taken for metallurgical and chemical analysis.

The seven day laboratory exposure test was performed in a Hollingshead cell comprising an inconel pot, a graphite crucible, a variable height graphite stirrer driven by a 60 r.p.m. geared motor and insulating lid of pyrocrete.

Test samples of $TiB_2$/C composite were glued to the bottom of the crucible with UCAR C-34 cement and were coated with boron oxide paste. Samples were then buried in synthetic cryolite (2 kg) and about 2 kg of aluminium metal granules were placed on top. The temperature was raised at 40°/hr to 980° C. and the stirrer was immersed so that it mixed both metal and bath. After seven days of operation at 980° C., the graphite crucible and contents were allowed to cool and then cross sectioned to enable visual and chemical analysis of the test samples. Test results confirmed that this long term dynamic exposure test can be used to screen RHM cathode materials, glues, formulations and baking rates in the laboratory prior to their use in industrial scale cells.

The following $TiB_2$ composite failure mechanisms observed in the industrial cells were reproduced in the test cell:

(a) delamination cracking of tiles and coatings;

(b) complete debonding of tiles due to stresses set up by sodium swelling;

(c) partial debonding of tiles due to chemical attack of the glue, and (d) deformation of tiles.

Furthermore, the dynamic exposure testing of $TiB_2$ composite materials also confirmed the following observations made during cell autopsies and laboratory investigations:

glued joints between tiles and cathode block are subject to chemical attack;

coating produced and baked under laboratory conditions performs much better than that produced and baked in the plant;

order of rank of laboratory performance is coated anthracite block>coated MLI block>tiled anthracite block>tiled graphite block;

structural integrity of the laboratory baked coatings is better than the laboratory baked tiles and much better than the plant baked coatings;

the bonding interface between coating and anthracite block is at least as resistant to bath and sodium as the coating itself.

A large variation in coating/tile quality was found on the cathode surface of the autopsied test cells. There appeared to be a random distribution of good, poor and missing coating/tile areas over the cathode surface. The presence of well bonded undeformed areas of coating-/tile demonstrated that the material could survive the aluminium cell environment provided a more consistent material could be produced.

No correlation between the material test results and the mixing, spreading, molding and curing process parameters could be established to explain the variability observed in the plant tests.

It was discovered that the condition of the exposed coating/tile material was related to the presence of oxides of titanium, including mixed oxides, in the material, the oxide content being determined using known X-ray Diffraction (XRD) analysis.

TABLE 1

$TiB_2$/Carbon Composite Baking Tests

| Test Sample | Protection Systems | Where Baked | Oxides of Titanium Relative XRD Peak Height |
|---|---|---|---|
| Coatings | | | |
| BN1 | Coke bed | Lab | 10 |
| BN1 | $B_2O_3$ only | Lab | 6 |
| BN1 | $B_2O_3$ only | Lab | 5 |
| BN1 | Al powder | Lab | 10 |
| BN1 | $B_2O_3$ + Al | Lab | 1 |
| BN1 | Graphicoat | Lab | 6 |
| BN1 | $TiB_2$/C icing | Lab | 5 |
| BN1 | $B_2O_3$ | Lab | 7 |
| BN1 | Graphicoat | Lab | 5 |
| BN1 | $TiB_2$/C icing | Lab | 7.5 |
| BN1-2C | Coke bed | Plant-28/5/87 | 4 |
| BN1-4C | " | " | 10 |
| BN1-6C | " | " | 4 |
| BN1-7C | " | " | 10 |
| BN1-8C | " | " | 24 |
| BN1-1C | $B_2O_3$ + Al | Plant-4/8/87 | 1 |
| BN1-3C | " | " | 2 |
| BN1-6C | " | " | 2 |
| Pitch Bonded | Coke bed + Ar | Lab | 34 |
| Pitch Bonded | Coke bed + Ar | Lab | 34 |

TABLE 1-continued $TiB_2$/Carbon Composite Baking Tests

| Test Sample | Protection Systems | Where Baked | Oxides of Titanium Relative XRD Peak Height |
|---|---|---|---|
| BM1 | Graphi-Coat + Al | Plant Test | 2 |
| BM1 | $TiB_2$/C icing + Al | Plant Test | 2 |
| Cast Tiles | | | |
| BR7 | Coke bed + Ar | Lab | 6 |
| BR7 | Coke bed | " | 8 |
| BR7 | $B_2O_3$ only | " | 5 |
| BR7 | $B_2O_3$ + Al | " | 2 |

The preferred $H_2O_3$/Al protection system was found to provide the best results, although the use of a sacrificial layer or coating, such as Graphi-Coat or $TiB_2$/C icing, in licu of the $B_2O_3$ component also produced acceptable results.

By preventing this low level oxidation of the $TiB_2$, the composite structure remains intact and a long service life is maintained.

The appreciable oxidation of $TiB_2$ evident during unprotected start-up was not anticipated since data sheets for $TiB_2$ indicate a high resistance to air oxidation at temperatures up to 1100° C. (ICD Group Inc., New York, N.Y., technical bulletin dated October 1979). Based on this data, the use of a coke bed to prevent air burn of the carbon matrix and the carbon matrix itself was relied upon to provide adequate oxidations protection for the $TiB_2$.

The data in Table 1 show that the conventional methods for protecting carbon from air burn are inadequate and that an unexpected synergism was found when a combination of $B_2O_3$ (or a suitable 'sacrificial' layer) plus Al was used to protect the $TiB_2$ material.

According to one practical embodiment, the $B_2O_3$-/Al protection system and cell start up procedure according to one embodiment is as follows:

1. $B_2O_3$ powder is evenly distributed over the cured composite surface of the cathode. An amount of about 80 kgs was used in the 100K ampere test cell. For difficult or vertical surfaces, a $H_3BO_3$ powder added to water to form a viscous paste is used.
2. Cover the $B_2O_3$ with aluminium foil to protect the powder against disturbance during subsequent operation. Overlapping strips of 1200 mm wide heavy duty foil has been found to be sufficient.
3. Cover the foil with aluminium "pellets". The amount should be calculated to provide at least 20 mm of molten metal over the highest part of the cathode. About 4 tons of pellets was found sufficient for the 100K ampere test cell.
4. Baking is carried out by directing oil fired burners between the anodes and the pellets, and heating at a rate of about 50° C./hr. After the aluminium has melted, the anodes can be lowered, current applied and the baking process continued.

It will be evident from the above discussion that the improved start-up procedure embodying the invention provides the following advantages over the prior art practices:

1. Provides improved protection for materials from oxidation damage at temperatures in excess of 400° C.
2. Provides low oxygen activity environment required to prevent oxidation of RHM and RHM containing composites when heated above 400° C.

3. Provides a quality control test for vendor supplied RHM composite articles (XRD analysis procedure for critical oxide impurities).
4. Improves reliability, uniformity and service life for RHM type cathodes.
5. Enables the use of RHM cathode materials which were previously unacceptable due to poor service life.

The above described start up procedure leaves a viscous boron oxide layer, or other layer derived from the boron oxide coating, on the surface of the cathode. The continued presence of the viscous boron oxide layer prevents a sloping cathode cell from operating in its desired manner. That is, the aluminium metal is restricted from draining to the metal sump. Other operational difficulties may also occur, as described elsewhere (E. N. KARNAUKHOV et al, *Soviet Journal of Non-Ferrous Metals Research*, English version Vol. 6 No. 1 1978, p. 16). Our own experience has shown that metal pooling may occur on the cathode surface, leading to uneven anode burning and/or short-circuiting, low current efficiency and general cell instability. The transition from start-up conditions to normal stable cell operation may therefore become problematic unless the boron oxide layer can be effectively removed at the end of the start-up phase. We have found that the establishment of stable operating conditions can be accomplished more efficiently by accelerating the rate of removal of the boron oxide. A number of methods have been found successful for achieving this removal. For instance, by flushing the cell with fresh metal the removal of the boron oxide has been promoted. However, the transferring of large volumes of molten metal into and out of the cell, whilst effective, is inconvenient, hazardous and undesirable.

We have discovered that the removal of boron oxide can be most conveniently facilitated by the chemical conversion in situ to a separate and more innocuous boron-containing phase that does not interfere with the draining of the cathode metal to the sump. By contacting the $B_2O_3$ phase with a Ti-containing species, chemical interaction between Ti and B is achieved leading to the conversion of $B_2O_3$ to $TiB_2$ and the precipitation thereof. Importantly, this chemical conversion process provides for the removal of the potentially problematic boron oxide viscous phase, which in turn allows for a rapid transition to stable and efficient drained cathode cell operation, as evidenced by normal bath temperatures and the uninterrupted filling of the metal sump at a rate consistent with the expected metal production rate.

Alternatively, it may be possible to use Ti in the form of an alloy of aluminium (e.g. Ti-Al) to provide close contact between the B and Ti species, respectively. The Ti-Al alloys are a preferred form of Ti addition since they are readily available as master alloys in the aluminium foundry industry. Furthermore, it is well known in aluminium foundry practice (e.g. AU 21393/83 "Removal of Impurities from Molten Aluminium") that the removal of metal impurities from molten aluminium can be achieved in a straightforward manner by contacting molten aluminium with a boron-containing material, thus leading to the generation of insoluble metal borides (e.g. (Ti, V) $B_2$). The formation and deposition of $TiB_2$ is, therefore, readily accomplished. However, the use of Ti-Al alloys for the removal of viscous boron-containing layers on the cathode surface, by the chemical conversion to another phase, has not been previously demonstrated.

While the use of Ti species is preferred for the above reasons, any RHM species, such as the metals in the fourth to sixth groups of the periodic system (Ti, Zr, Hf, V, Nb, Ta, Cr, Mo and W), which can form borides from the boron oxide layer may be used with acceptable results.

In one preferred form of the process, Ti-bearing additions, or other RHM boride forming species, such as those mentioned above, may be made directly to the electrolyte. Cryolite electrolytes are good solvents for oxide ores, so a convenient form of the Ti-containing species is as $TiO_2$, although other additives may also be employed. The Ti-containing species reacts with the $B_2O_3$ to form at least a $TiB_2$ precipitate, although other equally acceptable precipitates may form.

In each of the above cases, an aluminium-RHM diboride alloy phase is formed on the cathode surface, and this may offer additional restorative and other benefits to the cathode surface.

In laboratory tests, it was observed that a 1.875 g addition to the bath of $TiO_2$ effectively removed a 0.975 g layer of $B_2O_3$ originally located at the interface between the composite and the metal (i.e. no $B_2O_3$ could be detected at the interface by either visual or chemical microprobe methods). The mass of $TiO_2$ was chosen to be in excess of that needed for stoichiometric conversion to $TiB_2$ to ensure that all the $B_2O_3$ was removed. The mass ratio of Ti/B in $TiB_2$ is 2.218:1, and the mass ratio of Ti/B actually used was 3.71:1, which equates to a Ti mass excess of 67%. Thus, a $TiO_2/B_2O_3$ mass ratio of $1.875/0.975=1.92$ (i.e. $\approx 2$) is effective for removing the $B_2O_3$ layer at the cathode surface.

The $TiB_2$ precipitate is formed as randomly distributed and irregularly shaped fine particles ranging in size from less than 1 um to about 10 um. These particles sometimes aggregate as clusters consisting of from 3 or 4 to 30 or 40 particles. Because of the much higher density of $TiB_2$ compared to Al (i.e. 4.5 g/cm$^3$ vs 2.3 g/cm$^3$), the $TiB_2$ has been observed to form a sediment on the cathode surface and may, therefore, provide restorative and other benefits for cathodes containing RHM, such as $TiB_2$ (e.g. reduces solubility of the RHM). Similar comments apply equally to the other RHM boride forming species referred to above.

The above described post-start-up operations provide the means for enhancing the removal of a major portion of the boron oxide phase that is potentially disruptive to normal cell operation. The enhanced rate of removal facilitates the smooth transition from the start-up phase in which the boron oxide layer performs a useful protective function-to cell operation.

We claim:

1. A method of starting up an aluminum smelting cell having a cathode with an exposed cathode surface during start-up procedure of the cell, comprising forming on said cathode surface during the start-up procedure a liquid barrier substantially impervious to oxygen at temperatures up to about 1000° C. to protect the exposed cathode surface until the cell starts producing aluminum, said barrier comprising a first layer substantially impervious to oxygen and being liquid at temperature in the range of about 400° C. to about 700° C. and a second layer impervious to oxygen and substantially stable and being liquid at temperatures up to about 1000° C. during the start-up procedure.

2. A method of reducing the oxidation of refractory hard material of an aluminum smelting cell cathode composed at least in part of the refractory hard material RHM during start-up procedure of the cell wherein during operation the cathode is located beneath the cell contents, said method comprising adding to the cell before the cell starts producing aluminium at least one material which is liquid or molten at temperatures above about 400° C. and which is a stable liquid at temperatures up to about 1000° C., said material covering the surface of the cathode at temperatures above about 400° C. to form a barrier to oxygen, said barrier effectively limiting formation of oxidation products of the refractory hard material during start-up procedure of the cell.

3. The method of claim 2 wherein said cathode surface comprises the refractory hard material in a carbonaceous matrix.

4. The method of claim 3, wherein said refractory hard material is titanium diboride.

5. The method of claim 2, wherein said liquid barrier is formed on said cathode by adding a material which produces the molten or liquid oxygen barrier in situ.

6. In a method of starting up an aluminum smelting cell having an exposed surface of a cathode containing a refractory hard material, said surface including an oxidizable boron compound, wherein the improvement comprises the steps of:

oxidizing the cathode surface before the start-up procedure of the cell to form a first layer comprising boron oxide on the cathode surface, and adding aluminum metal before the start-up procedure of the cell to form a layer comprising aluminum metal over the first layer where the first layer and the aluminum layer remain liquid during the start-up procedure.

7. In a method of starting up an aluminum smelting cell having an exposed surface of a cathode containing a refractory hard material, said surface containing an oxidizable boron compound, wherein the improvement comprises the steps of:

adding aluminum metal before the start-up procedure of the cell to form a layer comprising aluminum metal over the cathode surface, and oxidizing the cathode surface during the start-up procedure of the cell to form a layer comprising boron oxide on the cathode surface where the first layer and the aluminum layer remain liquid during the start-up procedure.

8. A method of operating an aluminium smelting cell having a cathode with an exposed cathode surface during a start-up procedure of the cell, comprising forming a barrier substantially impervious to oxygen at temperatures up to about 1000° C. on said cathode surface before the start-up procedure, said barrier comprising a first layer substantially impervious to oxygen at temperatures and liquid in the range of about 400° C. to about 700° C. and a second layer comprising aluminum over said first layer, wherein the first layer comprises boron oxide, and removing at least a portion of the boron oxide from the aluminum smelting cell proximate the end of the start-up procedure by contacting the boron oxide with a phase to cause conversion of the boron oxide and substantial removal thereof from the cell.

9. The method of claim 8, wherein the boron oxide is removed by precipitating a refractory hard material boride by adding a refractory hard material boride forming species to the cell.

10. The method of claim 8, wherein boron oxide is removed by precipitating a refractory hard material RHM boride comprising the step by adding a RHM boride forming species to the cell.

11. The method of claim 10, wherein the species is selected from the transition metals Ti, Zr, Hf, V, Nb, Ta, Cr, Mo and W.

12. The method of claim 11, wherein the species is added to the electrolyte.

13. The method of claim 12, wherein the species is in the form of an oxide.

14. The method of claim 10, wherein the species is added to the melt in the form of a RHM boride forming species.

15. Method of claim 10, wherein the RHM boride is precipitated in the form of particulates or a sediment on the cathode surface.

16. A method of start up an aluminum smelting cell having a cathode with an exposed cathode surface during a start-up procedure of the cell, comprising forming a liquid barrier substantially impervious to oxygen at temperatures up to about 1000° C. on said cathode surface where the barrier, once liquid, remains a liquid during the start-up procedure to protect the exposed cathode surface until the cell starts producing aluminum, said barrier comprising a first layer substantially impervious to oxygen at temperature in the range of about 400° C. to about 700° C. and a second layer comprising aluminum over said first layer.

17. The method of claim 1 or 16 wherein said cathode surface comprises a refractory hard material in a carbonaceous matrix.

18. The method of claim 17, wherein said refractory hard material is titanium diboride.

19. The method of claim 1 or 16 wherein said first layer of material comprises boron oxide.

20. The method of claim 19, 6 or 8, wherein the boron oxide of the first layer is formed in situ on said cathode surface from a material which converts to boron oxide.

21. The method of claim 19, 6 or 7, further comprising treating said boron oxide layer after start-up with boron oxide-reactive compound to remove the boron oxide.

22. The method according to claim 21 wherein the boron oxide-reactive compound is comprised of titanium.

23. The method accounding to claim 21 wherein the boron oxide-reactive compound is comprised of $TiO_2$.

24. The method of claim 21 wherein the boron oxide-reactive compound contains at least one species selected from the group consisting of Zr, Hf, V, Nb, Ta, Cr, Mo and W.

25. The method of claim 1 or 16 wherein said cathode comprises a composite material that is wettable by molten aluminum.

26. The method of claim 1 or 16, wherein said first layer is formed on the cathode from a material which produces the first layer in situ.

27. Method of claim 1, 16, 6, 7 or 8, wherein said liquid layers are formed on the cathode surface prior to aluminum smelting operation of the cell.

* * * * *